US008123610B2

(12) United States Patent
Hornik

(10) Patent No.: US 8,123,610 B2
(45) Date of Patent: Feb. 28, 2012

(54) WAGERING GAME WITH GROUP FREE-SPIN BONUS

(75) Inventor: Jeremy M. Hornik, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 813 days.

(21) Appl. No.: 11/991,591

(22) PCT Filed: Sep. 6, 2006

(86) PCT No.: PCT/US2006/034877

§ 371 (c)(1),
(2), (4) Date: Mar. 6, 2008

(87) PCT Pub. No.: WO2007/030632

PCT Pub. Date: Mar. 15, 2007

(65) Prior Publication Data

US 2010/0222123 A1 Sep. 2, 2010

Related U.S. Application Data

(60) Provisional application No. 60/714,463, filed on Sep. 6, 2005.

(51) Int. Cl.
*A63F 9/24* (2006.01)

(52) U.S. Cl. ..... 463/20; 463/16; 463/25

(58) Field of Classification Search ..... 463/16–20, 463/25, 29
See application file for complete search history.

(56) References Cited

U.S. PATENT DOCUMENTS

| | | | | |
|---|---|---|---|---|
| 4,805,907 | A * | 2/1989 | Hagiwara | 463/26 |
| 4,856,787 | A * | 8/1989 | Itkis | 273/237 |
| 5,116,055 | A * | 5/1992 | Tracy | 463/27 |
| 6,206,782 | B1 * | 3/2001 | Walker et al. | 463/25 |
| 6,443,452 | B1 * | 9/2002 | Brune | 273/143 R |
| 6,572,471 | B1 * | 6/2003 | Bennett | 463/16 |
| 2002/0039923 | A1 * | 4/2002 | Cannon et al. | 463/42 |
| 2002/0180152 | A1 * | 12/2002 | Gauselmann | 273/292 |
| 2003/0224852 | A1 * | 12/2003 | Walker et al. | 463/20 |

* cited by examiner

*Primary Examiner* — Omkar Deodhar
(74) *Attorney, Agent, or Firm* — Nixon Peabody LLP

(57) ABSTRACT

A method of conducting a wagering game on a plurality of gaming machines. The method includes receiving wagers from players at the plurality of gaming machines to play a basic game. A plurality of symbols is displayed on each of the plurality of gaming machines. The plurality of symbols indicate a randomly selected outcome at each of the plurality of gaming machines. The method also includes aggregating a plurality of special-game triggering events at the plurality of gaming machines. In response to a predetermined number of the plurality of special-game triggering events being achieved, a community-based special event involving eligible of the plurality of gaming machines is initiated.

21 Claims, 7 Drawing Sheets

WAGERING GAME WITH GROUP FREE-SPIN BONUS

CROSS REFERENCE TO RELATED APPLICATIONS

This application is a U.S. national phase of International Application No. PCT/US2006/034877, filed Sep. 6, 2006, which claims the benefit of priority of U.S. Provisional Patent Application No. 60/714,463, filed Sep. 6, 2005, both of which are incorporated by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a bank of gaming machine having a bank-wide bonus game.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

However, the bonus games in many current gaming machines are played at a single gaming machine, by a single player. Such a set-up isolates the players from one another and does not create any type of community among players at a bank of gaming machines.

Therefore, there is a need for a bonus game that is achieved and played by a plurality of gaming machines.

SUMMARY OF THE INVENTION

According to one aspect of the present invention, a method of conducting a wagering game on a plurality of gaming machines is provided. The method includes receiving wagers from players on the plurality of gaming machines to play basic games. A plurality of symbols is displayed on each of the plurality of gaming machines. The plurality of symbols indicates a randomly selected outcome. The method also includes aggregating a plurality of special-game triggering events at the plurality of gaming machines. In response to a predetermined number of the plurality of special-game triggering events being achieved, a community-based special event involving eligible ones of the plurality of gaming machines is initiated.

According to another aspect of the invention, a computer readable storage medium is encoded with instructions for directing a gaming device to perform the above method.

According to yet another aspect of the invention, a gaming system is provided. The gaming system includes a plurality of gaming machines for playing wagering games and a controller coupled to the plurality of gaming machines. The controller is programmed to aggregate a plurality of special-game triggering events at the plurality of gaming machines. In response to a predetermined number of the plurality of special-game triggering events being achieved, the controller is also programmed to initiate a community-based special event that involves eligible ones of the plurality of gaming machines.

According to yet another embodiment of the present invention, a method for playing a wagering game at a plurality of gaming machines is provided. The method includes conducting the wagering game on at least one of the plurality of gaming machines, such that the at least one of the plurality of gaming machines has a plurality of symbols that indicate a randomly selected outcome of the wagering game. At least some of the plurality of symbols are displayed to indicate the randomly selected outcome. In response to at least one of the displayed symbols indicating a triggering outcome, it is determined whether a predetermined number of triggering outcomes have been achieved. A bonus game is played in response to the predetermined number of triggering outcomes being achieved. A bonus award is awarded to players at each of the plurality of gaming machines that qualify for the bonus game, in response to the bonus game achieving a winning outcome.

Additional aspects of the invention will be apparent to those of ordinary skill in the art in view of the detailed description of various embodiments, which is made with reference to the drawings, a brief description of which is provided below.

DETAILED DESCRIPTION

Figure 1:
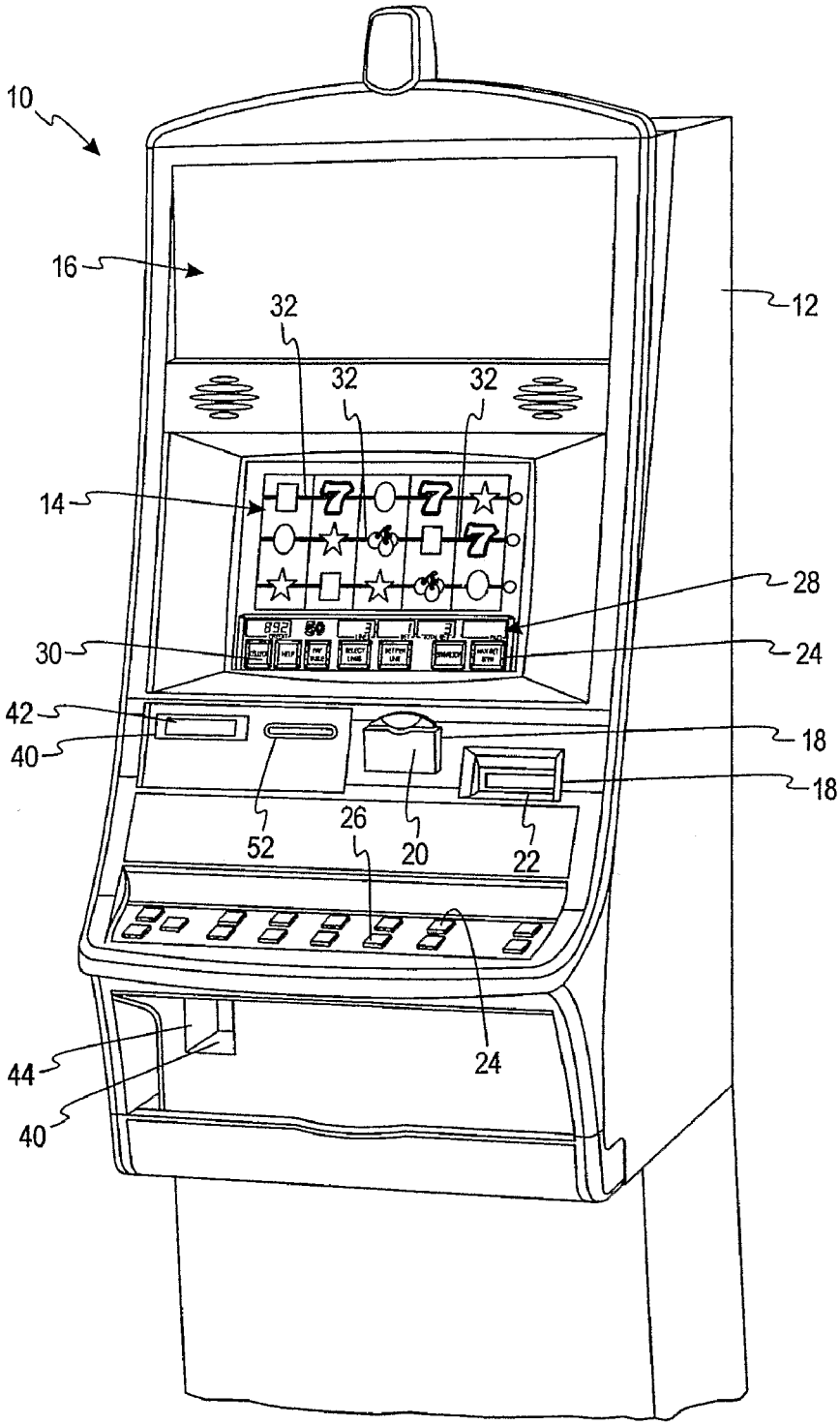
FIG. 1 is a perspective view of a gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1, or may be located outboard of the housing 12 and connected to the housing 12 via a variety of different wired or wireless connection methods. Thus, the gaming machine 10 comprises these components whether housed in the housing 12 or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire monitor (or a portion thereof) to allow players to make game-related selections. Alternatively, the primary display 14 of the gaming machine 10 may include a number of mechanical reels to display the outcome in visual associated with at least one pay line 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one pay line 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1 as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 2:
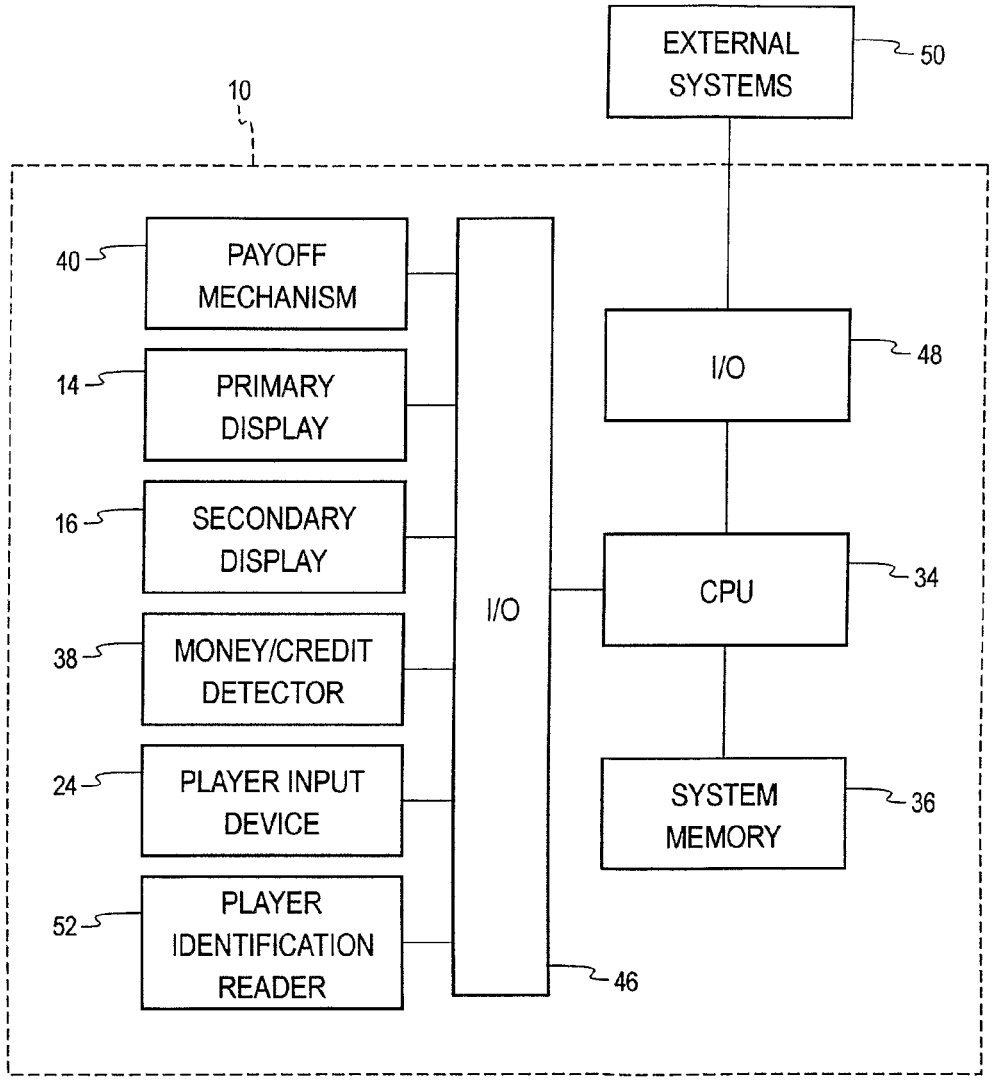
FIG. 2 is a block diagram of a control system suitable for operating the gaming machine.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10 bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36.

Figure 3:
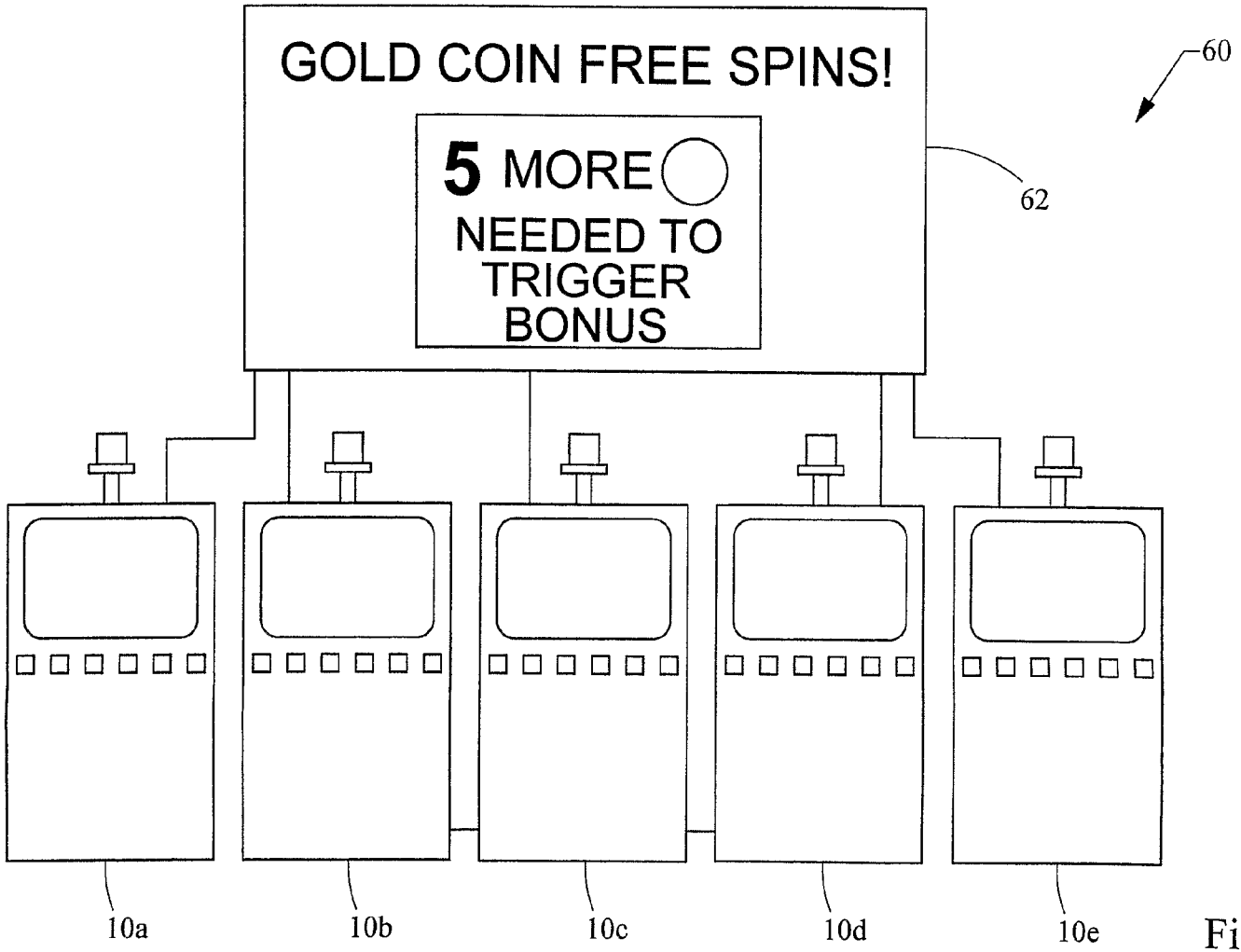
FIG. 3 illustrates a gaming system according to one embodiment of the present invention.

Turning now to FIG. 3, a gaming system 60 including a plurality of gaming machines 10*a*, 10*b*, 10*c*, 10*d*, 10*e* is illustrated. As illustrated, the plurality of gaming machines 10*a-e* (sometimes also referred to as a "bank"), are coupled to each other and also to a community display 62. In the illustrated embodiment, the community display 62 includes a video screen that displays information to the players at the bank of gaming machines 10*a-e*. As illustrated, the community display 62 includes a notice to all players at the bank of gaming machines 10*a-e* of how many bonus-game symbols (in this illustration, the bonus-game symbols are gold-coin symbols) are needed to begin a bank-wide bonus. In this illustration, five more gold-coin symbols are needed to begin the community bonus game. The community bonus game is more fully described below.

Figure 4:
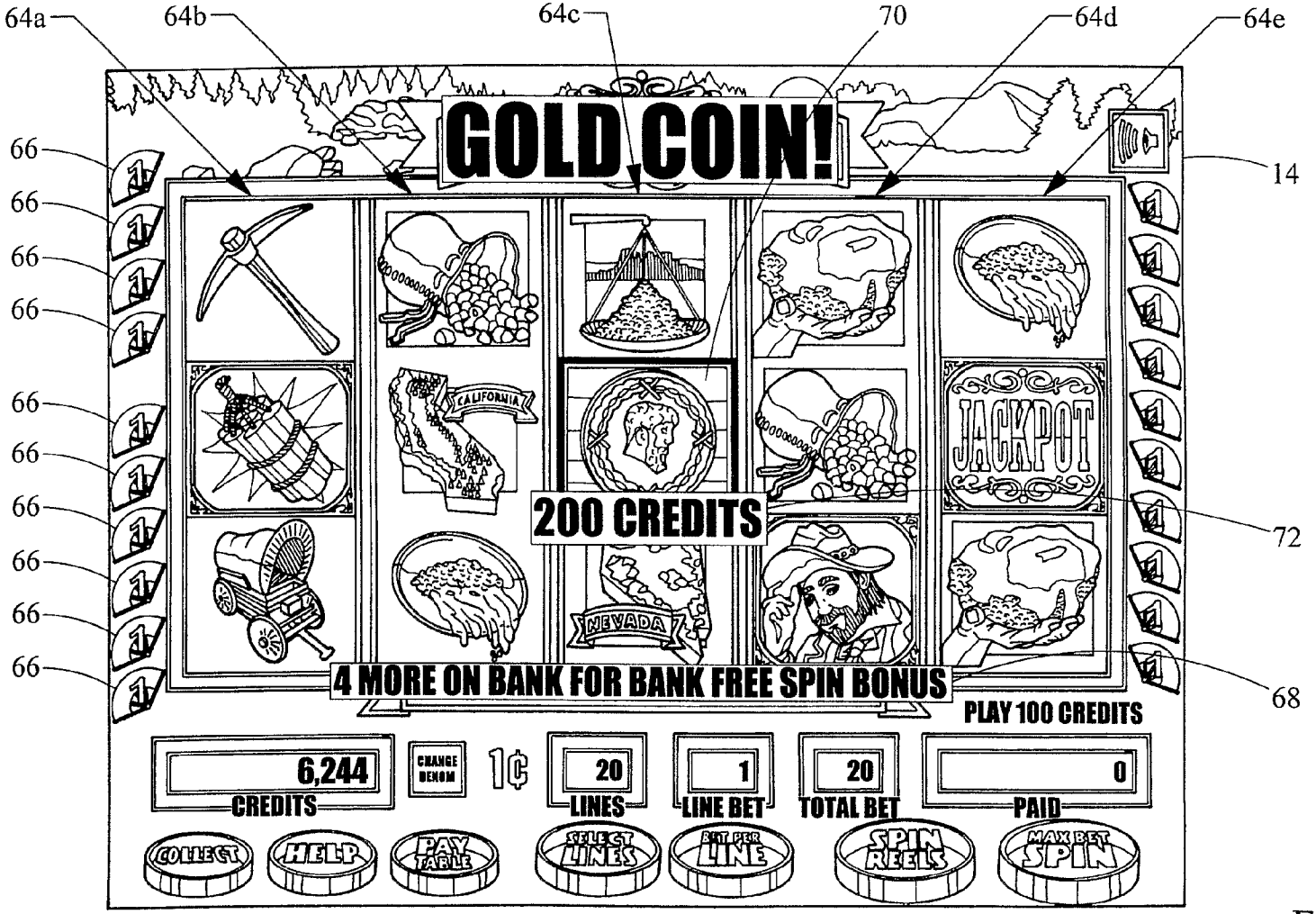
FIG. 4 is a screen of the primary display of the gaming machine of FIG. 1.

FIG. 4 illustrates the primary display 14 of one of the plurality of gaming machines 10*a-e* according to one embodiment of the present invention. In this embodiment, the basic game is a slot machine game, with symbols on five different reels 64*a*, 64*b*, 64*c*, 64*d*, 64*e*. The reels 64*a-e* may be either traditional mechanical reels, electromechanical reels, or they may be computer-generated images of reels, with each reel composed of a plurality of symbols. In this embodiment, there are multiple pay lines 66 extending across the various reels 64*a-e*. While multiple pay lines 66 are shown, a gaming machine having a single pay line will also work with the present invention.

During the basic game, the player places a wager on any number of pay lines 66. In the illustrated embodiment, the wager may be between one and five credits per pay line 66. However, in other embodiments, other wager amounts may be made. Once the player has placed the wager, the reels 64*a-e* begin to spin. The result of the spin may be displayed on an outcome indicator 68, and winning pay lines 66 may be highlighted on the primary display 14. In the illustrated example, a gold coin symbol 70 is located on the third reel 64*c*. The player is awarded a basic game payout of a predetermined amount as shown on a pop-up screen 72 that appears below the gold coin symbol 70.

Figure 5:
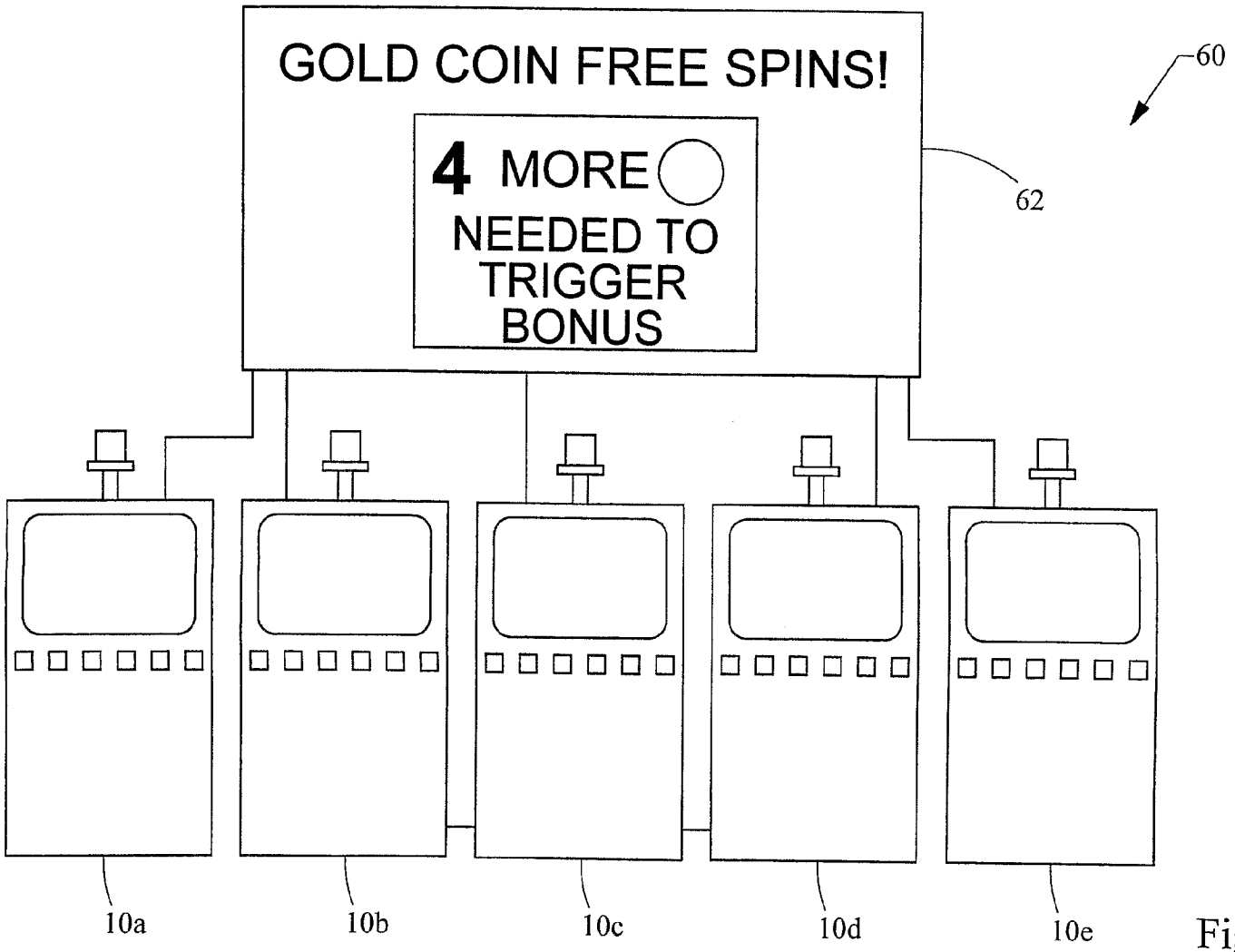
FIG. 5 illustrates the gaming system of FIG. 3 after a particular event occurs.

In addition to winning the basic game payout for the appearance of the gold coin symbol 70 in FIG. 3, the number of gold coin symbols 70 needed to achieve the bank-wide bonus is decreased by one (FIG. 5). As shown in FIG. 5, after the gold coin symbol 70 appears during the basic game on one of the plurality of gaming machines 10*a-e*, the community display 62 decreases the required number of gold coin symbols 70 needed to trigger the bonus by one. Instead of needing five gold coin symbols 70 to achieve the bonus game, only four gold coin symbols 70 are needed.

Figure 6:
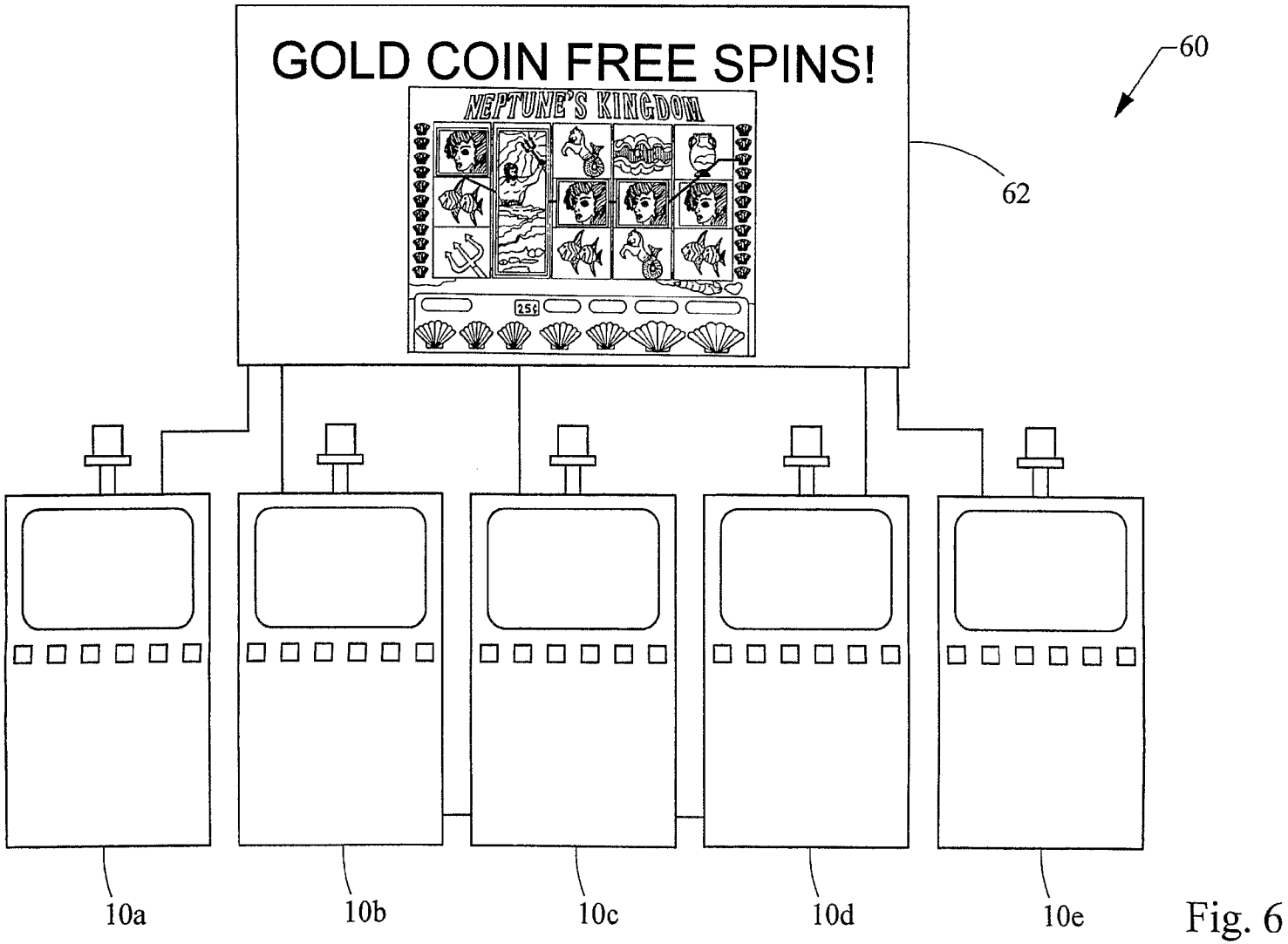
FIG. 6 illustrates a bonus game being played on the gaming system of FIG. 3.

Turning now to FIG. 6, an illustration of the bank-wide bonus game is illustrated. In this embodiment, the bank-wide bonus game are free spins of the basic game. However, instead of the free spins occurring independently on every one of the gaming machines 10*a-e*, the free spins are played for all of the gaming machines 10*a-e*. In other words, all of the gaming machines 10*a*-10*e* have the same result. As illustrated in FIG. 6, one of the free spins is shown on a portion of the community display 62 and the game includes reels that could be mechanical reels, electromechanical reels, or computer-generated images of reels, with each reel composed of a plurality of symbols. The plurality of symbols of the bonus game may be the same as the symbols of the base game or the plurality of symbols of the bonus game may be different than the symbols of the base game.

The result of the free-spin bonus games awarded to the player at each one of the gaming machines 10*a-e*. In some embodiments, the free spins are also displayed on the individual gaming machines 10*a-e*. In other embodiments, the free spins are only illustrated on the community display in the form of signage 62, and the players are encouraged to look up at the signage 62 for the results of the free spins.

If the free spins result in any type of an award (credits, more free spins, etc.), the awards are granted on each of the gaming machines 10*a-e*. After the free spins are played, the gaming machines 10*a-e* return to the basic games and continue as normal. In some embodiments, the players may be allowed to continue playing the basic game while the free spins are being played. In other embodiments, all game play is suspended until the bonus game is finished, and any awards have been awarded.

Figure 7:
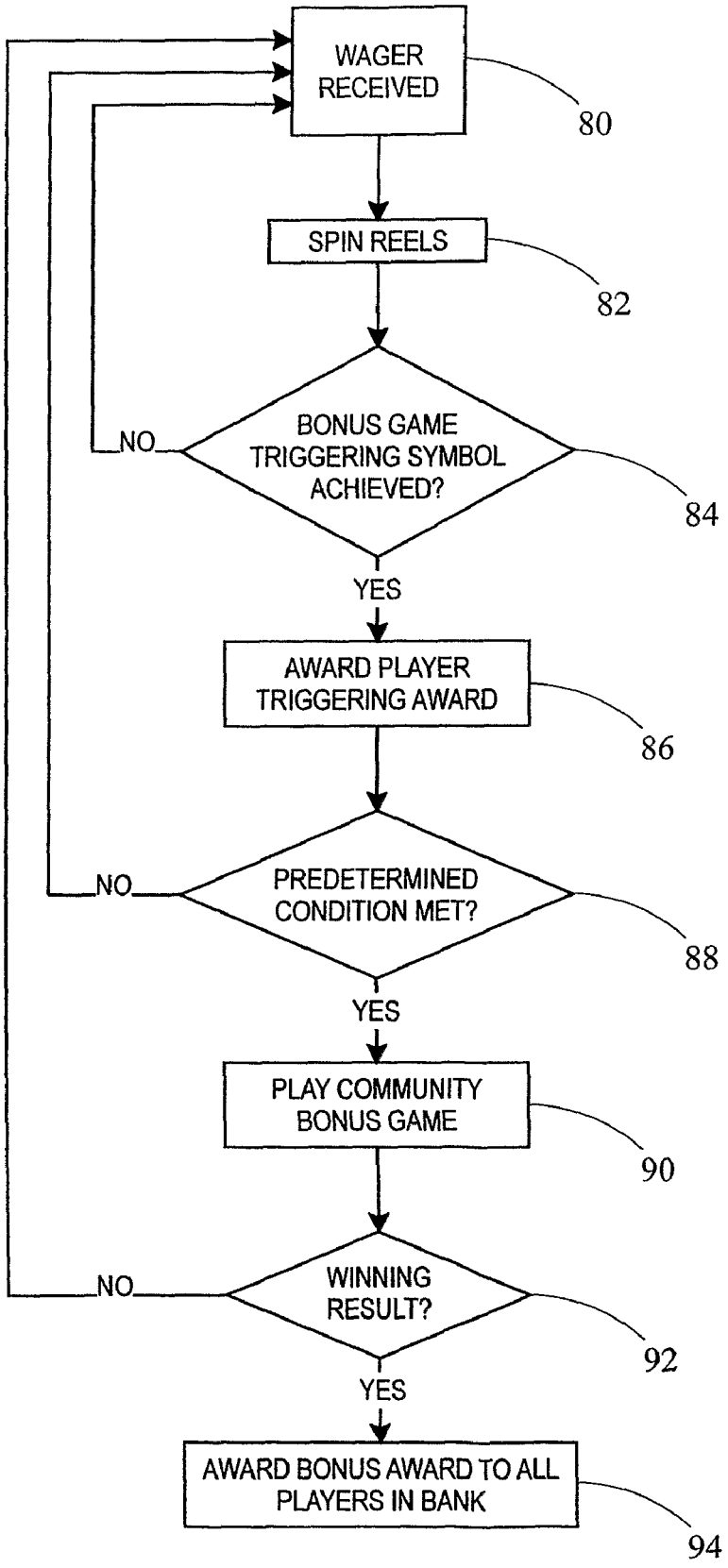
FIG. 7 illustrates a flow chart describing the operation of one embodiment of the present invention.

Turning now to FIG. 7, the operation of the gaming system 60 according to one embodiment of the present invention will be described. At step 80, the wagering game receives a wager, and the reels of the gaming machine that received the wager are spun (step 82). After the reels have stopped spinning, it is determined whether a bonus-game triggering symbol is achieved in an active pay line (step 84). If it is not, then the process returns to step 80, and the game begins again.

If the bonus game triggering symbol (or symbols) is displayed on an active pay line, then the player is awarded a triggering award (if one exists) at step 86. The triggering award may be a set credit amount, one or more free spins, a multiplier, or other known award. At step 88, it is then determined whether a predetermined condition is met. In the embodiments described in FIGS. 3-6, the predetermined condition is five gold coins. However, in other embodiments, the predetermined condition can be other things, such a predetermined number of credits wagered in a predetermined amount of time. If the predetermined condition has not been met, the wagering game continues to step 80, and the game begins again.

If the predetermined condition has been met, a community bonus game is played at step 90. It is then determined if the community bonus game results in a winning outcome (step 92). If not, the process goes back to step 80 and the game begins again. If a winning result (or outcome) is achieved, then all of the players in the bank of gaming machines 10*a-e* are awarded a bonus award (step 94).

In the embodiments described in FIGS. 3-7, the gaming system 60 counts down from five gold coins. In other embodiments, there may be any number of gold coins required to achieve the bonus game. In other embodiments, the required symbol may not be a gold coin, but may be another symbol or a predetermined symbol combination.

In the above-described embodiments, the gold coins appeared as a part of the basic game. In other embodiments, the gold coins could be granted as a result of achieving another symbol, symbol combination, bonus game, or a mystery prize.

In some embodiments, the player's individual prize for achieving the gold coin symbol 70 may be entry to a different bonus game (as opposed to a fixed prize described above and illustrated in FIG. 4).

In some embodiments, the bonus game may be any type of bonus game, including player-selectable bonus games, with the players at each of the gaming machines 10*a-e* taking turns selecting elements. In some embodiments, only the player that triggers the bonus game may do the selecting.

In some embodiments having a free-spin bonus game, the number of free spins may be any number of free spins. The number of free spins may be a fixed number. In other embodiments, the bonus reels may continue to spin until a winning combination is achieved. In other embodiments, the bonus reels may continue to spin until a losing combination is achieved.

In some embodiments, the gold coin feature may not be available with all wagers. The gold coin feature may only be available on maximum wagers. Alternatively, the gold coin feature may be available on all wagers. In gaming systems where the players at the different gaming machines 10*a-e* place different wagers, the result of the free spins (or bonus game) may be altered by the amount of the players' wagers. For example, a player who wagers 5 credits may be awarded five times as much as a player who wagers only a single credit. In other embodiments, only players who place the maximum wager are awarded the results of the free spins.

In some embodiments, the result of achieving the predetermined condition of FIG. 7 is not limited to a bonus game, but instead may be any type of special event. For example, the special event may be a progressive game or another type of secondary game.

In some embodiments, the bonus game award that is awarded to all of the players at the bank of gaming machines 10*a-e* may be a set amount. In other embodiments, the bonus game award may be a progressive jackpot that increases as the players place wagers. In other embodiments, the bonus game award may be a non-monetary award, such as a free spin or a multiplier.

In some embodiments, the basic game may be other than a slots type game. The basic game may be a poker game, a blackjack game, a keno game, or other known wagering game.

In the embodiment described in FIGS. 3-7, the community bonus game was limited to a bank of gaming machines 10*a-e*. However, the gaming machines could be all of a particular type within a casino, state or other boundary. Alternatively, the gaming machines could be any linked gaming machines.

Each of these embodiments and obvious variations thereof is contemplated as falling within the spirit and scope of the claimed invention, which is set forth in the following claims.

What is claimed is:

1. A method of conducting a wagering game on a plurality of gaming machines associated with each other, the method comprising:

receiving wagers from players at the plurality of gaming machines to play basic games;

displaying a plurality of symbols on each of the plurality of gaming machines corresponding to each play of the basic games, the plurality of symbols indicating one of a plurality of randomly selected outcomes for each play of the basic games at each of the plurality of gaming machines, the plurality of randomly selected outcomes including a special-game triggering event;

aggregating a plurality of the special-game triggering events from the plurality of gaming machines only when a special-game triggering event is selected from the plurality of randomly selected outcomes from the plurality of plays from each of the plurality of gaming machines;

in response to a predetermined number of the plurality of special-game triggering events being achieved, initiating a community-based bonus game involving inputs from only eligible ones of the plurality of gaming machines and including a winning outcome for all eligible ones of the plurality of gaming machines.

2. The method of claim 1, further comprising awarding the players at each of the plurality of gaming machines a special-event award in response to the community-based special event achieving a winning outcome.

3. The method of claim 2, wherein the special event award is selected from the group consisting of a free spin, a multiplier, a progressive jackpot, and a bonus jackpot.

4. The method of claim 2, wherein the special event includes one or more spins of a plurality of symbol-bearing reels.

5. The method of claim 1, wherein the initiating of the community-based bonus game comprises at least one of the players at the plurality of gaming machines selecting a player-selectable element.

6. The method of claim 1, wherein in response to the special-game triggering event being achieved, awarding the player at one of the gaming machines a base game award.

7. A computer readable, non-transitory, storage medium encoded with instructions for directing a gaming device to perform the method of claim 1.

8. A gaming system comprising:

a plurality of gaming machines for playing wagering games associated with each other, the wagering games each including one of a plurality of randomly selected outcomes, the randomly selected outcomes including a special-game triggering event; and a controller coupled to the plurality of gaming machines and programmed to aggregate a plurality of special-game triggering events from the plurality of gaming machines only when a special-game triggering event is selected from the plurality of randomly selected outcomes from the plurality of plays from each of the plurality of gaming machines, and in response to a predetermined number of the plurality of special-game triggering events being achieved, initiate a community-based bonus game involving inputs from only eligible ones of the plurality of gaming machines and including a winning outcome for all eligible ones of the plurality of gaming machines.

9. The gaming system of claim 8 further comprising a community display coupled to the controller, the community display for displaying the community-based special event.

10. The gaming system of claim 9 wherein the community display displays a current number of aggregated special-game triggering events until the predetermined number of the plurality of special-game triggering events is achieved.

11. The gaming system of claim 8 wherein the wagering game is selected from the group consisting of a slots game, a poker game, a roulette game, a blackjack game, and a keno game.

12. The gaming system of claim 8 wherein the controller is further operative to award a player at a gaming machine that achieves one of the plurality of special-game triggering event a triggering award.

13. The gaming system of claim 8 wherein the controller is located in one of the plurality of gaming machines.

14. A method for playing a wagering game at a plurality of gaming machines associated with each other, the method comprising:

conducting the wagering game on at least some of the plurality of gaming machines, the at least some of the plurality of gaming machines each having a plurality of symbols that indicate a randomly selected outcome of the wagering game corresponding to each play of the wagering games;

displaying at least some of the plurality of symbols to indicate the randomly selected outcome;

only in response to at least one of the displayed symbols indicating a triggering outcome, determining whether a predetermined number of triggering outcomes have been achieved based on the triggering outcome and previously occurring triggering outcomes from the plurality of plays from each of the other ones of the plurality of gaming machines;

playing a community-based bonus game in response to the predetermined number of triggering outcomes being achieved, the community-based bonus game involving inputs from only qualified ones of the plurality of gaming machines; and in response to the bonus game achieving a winning outcome, awarding an award to players at each of the plurality of gaming machines that qualify for the bonus game.

15. The method of claim 14, further comprising displaying the bonus game on a community display coupled to each of the plurality of gaming machines.

16. The method of claim 14, further comprising displaying the number of triggering outcomes achieved on a community display coupled to each of the plurality of gaming machines.

17. The method of claim 14, further comprising displaying the bonus game on each of the plurality of gaming machines.

18. The method of claim 14, further comprising awarding the player at the at least one of the plurality of gaming machines a triggering award in response to at least one of the displayed symbols indicating a triggering outcome.

19. The method of claim 14, wherein the awarding includes determining whether each of the plurality of gaming machines qualifies for the bonus game.

20. The method of claim 19, wherein qualifying for the bonus game comprises placing a minimum wager on the wagering game.

21. The method of claim 14, wherein only one of the plurality of gaming machines plays the bonus game and each of the plurality of gaming machines is awarded the award in response to the bonus game achieving a winning outcome.

* * * * *